US006139394A

United States Patent [19]

Maxim

[11] Patent Number: 6,139,394

[45] Date of Patent: Oct. 31, 2000

[54] STUFFED ANIMAL FIGURE WITH SOUND AND ILLUMINATED FACE

[76] Inventor: John G. Maxim, 863 Coventry St., Boca Raton, Fla. 33487

[21] Appl. No.: 09/449,264

[22] Filed: Nov. 24, 1999

[51] Int. Cl.[7] ..... A63H 33/22

[52] U.S. Cl. ..... 446/219; 446/297; 446/397; 446/485

[58] Field of Search ..... 446/81, 219, 268, 446/295, 297, 397, 485

[56] References Cited

U.S. PATENT DOCUMENTS

| | | | |
|---|---|---|---|
| 2,699,621 | 1/1955 | Levinson | 446/219 |
| 4,464,861 | 8/1984 | Fogarty | 446/370 |
| 4,521,205 | 6/1985 | Spector | 446/219 |
| 4,547,171 | 10/1985 | Horimoto | 446/485 |
| 5,114,376 | 5/1992 | Copley et al. | 446/485 |
| 5,211,282 | 5/1993 | Ting | 200/303 |
| 5,267,886 | 12/1993 | Wood et al. | 446/268 |
| 5,281,180 | 1/1994 | Lam et al. | 446/175 |
| 5,328,401 | 7/1994 | Demars | 446/268 |
| 5,376,038 | 12/1994 | Arad et al. | 446/297 |
| 5,672,090 | 9/1997 | Liu | 446/268 |
| 5,830,034 | 11/1998 | Ciechanowski et al. | 446/219 |

*Primary Examiner*—Sam Rimell

*Attorney, Agent, or Firm*—Oltman, Flynn & Kubler

[57] ABSTRACT

An imitative figure apparatus includes a figure body with a body torso and a body head having a face portion with an illumination sheet of luminescent material for absorbing and storing ambient light energy and for producing illumination from the stored light energy, the sheet being oriented so that the produced illumination is directed forwardly from the figure; and a translucent cover secured over the illumination sheet, the translucent cover representing at least part of the face portion. The translucent cover preferably is configured as a dome having a dome apex. The apparatus additionally includes a mouth and nose representing structure secured to the exterior of the dome substantially at the dome apex. The dome has a dome inner surface which is frosted, and additionally includes eye representing structures having two eye support structures, each eye support structure being fitted with an eye disk for representing the pupil of an eye and which is visible through the dome; so that light emitted by the luminescent sheet enhances the visibility of the eye disks within the dome and also causes each eye disk to cast a shadow on the dome inner surface which appears from outside the dome to surround the eye disks and thus to represent eye whites around eye pupils. An electric light circuit is preferably provided for illuminating the face dome, and sound generating circuits preferably are provided which are activated by applying pressure to the figure mouth or squeezing the figure torso.

18 Claims, 5 Drawing Sheets

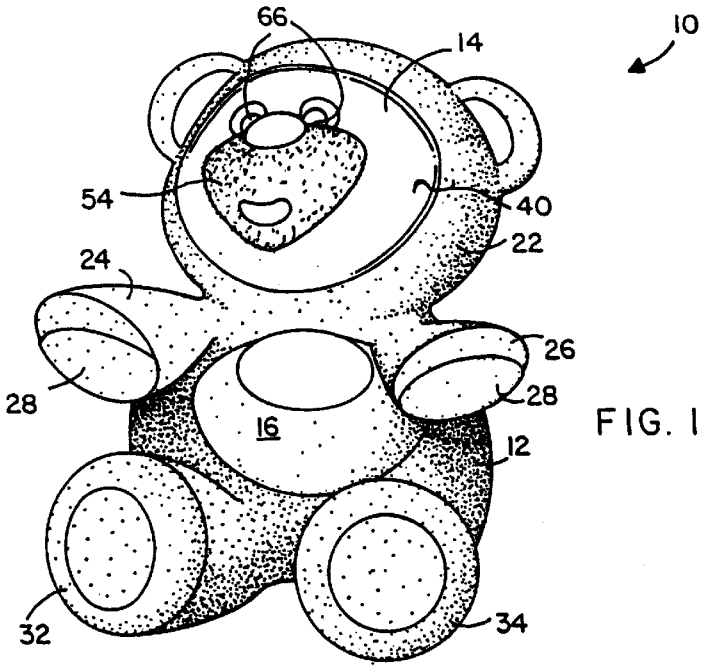
FIG. 1
FIG. 2
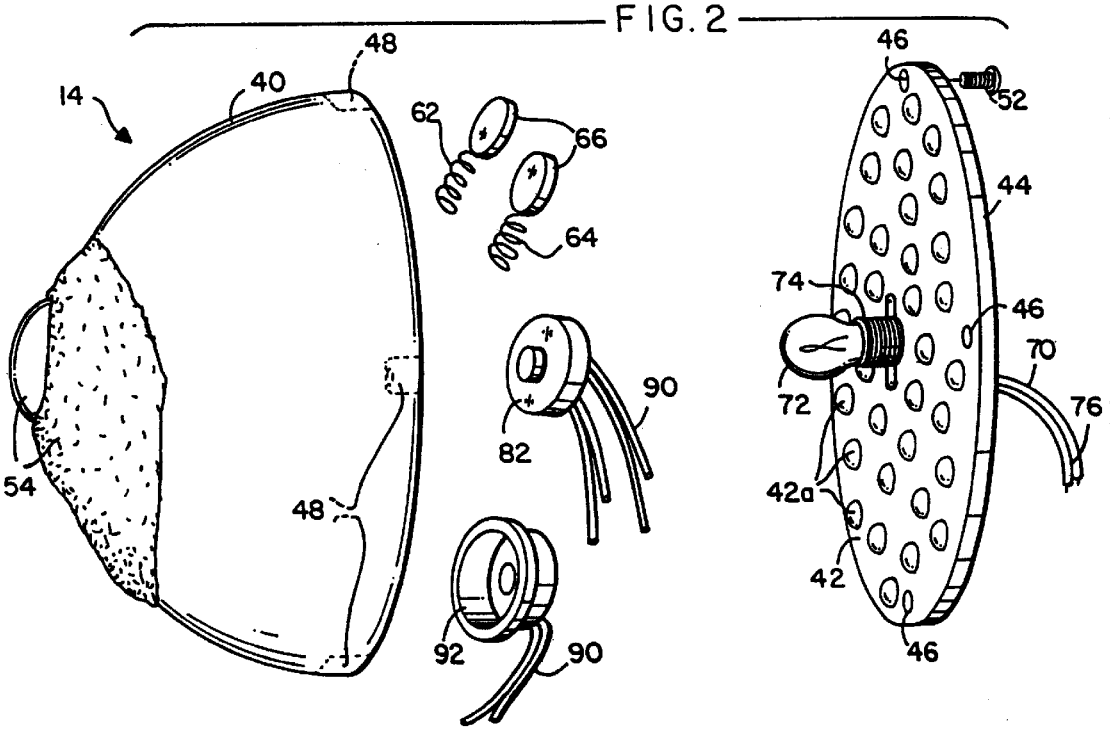

STUFFED ANIMAL FIGURE WITH SOUND AND ILLUMINATED FACE

BACKGROUND OF THE INVENTION

1. Field of the Invention

The present invention relates generally to the field of toys for children. More specifically the present invention relates to a figure imitating the appearance of an animal or a person, preferably taking the form of a stuffed animal which includes a body having a translucent face portion, and which contains means for illuminating the face portion and generating fanciful sounds intended to represent vocal sounds made by the represented character. The figure body is preferably configured as a Teddy Bear having a torso with a head and four limbs in the form of two arms with paws and two legs. The torso and head contain cavities for retaining mechanical and electrical elements, and the conventional face portion material is replaced with a circular sheet of luminescent material covered by a translucent dome having a buffed or abraded inner surface to obscure internal mechanisms from view. The dome apex exterior surface may be covered by a fur covered nose and mouth structure marked and configured to represent a figure nose and mouth. Anchored to the inside surface of the dome apex and behind the nose and mouth structure are first ends of two coil springs which project toward the luminescent sheet. An eye disk of black pigmented metal or plastic is affixed to each of the spring second ends.

The luminescent sheet absorbs and stores a quantity of energy radiated by ambient lighting as well as internal figure electric lighting and illuminates when the ambient lights are shut off, so that the figure face glows. The eye disks appear in silhouette against the luminescent sheet to represent figure eye pupils and each eye disk also casts a visible shadow against the dome which appears to surround the given eye pupil and to suggest the white of the figure eye. The eye disks are mounted on the coil springs so that any sudden displacement, or even a subtle movement, of the figure causes the eye disks to move relative to the dome and subsequently to giggle and bounce on the springs until their kinetic energy is all converted to heat and dissipated, creating a pleasing and relatively life-like animated effect.

The figure preferably contains four optional electric circuits, one electric light source circuit, first and second sound circuits and a rheostat circuit. The electric light source is preferably an incandescent bulb located within the dome with wiring extending down into the chest cavity. The electric light source is powered through a light source circuit including a battery located in the torso cavity wired to a first pressure switch in the nose and mouth structure, to a second pressure switch in the chest cavity and to a magnetic switch in each of the paws. The electric light circuit contains capacitor means causing power reaching the electric light source to increase progressively upon activation to its maximum magnitude, such that light emitted by the electric light source gradually increases in brightness to full intensity.

The torso cavity also contains the first sound circuit which is constructed to emit a stored sound simulating a kiss, a giggle, a laugh, or some other sound when pressure is applied against the figure mouth such as by a person or by the mouth region of another such figure, and the second sound circuit to emit motion responsive sounds representing vocal sounds when the torso is squeezed. The second sound circuit is preferably incorporated into a mechanical structure which is contained within the chest cavity.

2. Description of the Prior Art

There have long been toy animals and dolls, some of which have contained electric illumination circuits. Others have contained circuits and hardware for generating simulated vocal sounds when activated in some way.

Stuffed toy body illumination is disclosed in DeMars, U.S. Pat. No. 5,328,401, issued on Jul. 12, 1994. DeMars teaches a stuffed animal which is described as a blushing toy, having translucent domes mounted at either side of the face to define cheeks, each cheek dome containing an incandescent bulb wired to an electric circuit. The circuit includes a facial plate which moves rearwardly when a child presses against the animal face and thereby completes the circuit to light the bulbs and makes the cheeks glow and appear to blush.

Copely, et al., U.S. Pat. No. 5,114,376 issued on May 19, 1992 reveals a toy animal with an illuminated belly. Copely includes a translucent dome over the belly area and an incandescent bulb belly light wired to an electric circuit containing a touch-activated switch protruding from the apex of the dome. Touching the switch activates the belly light, which remains light until a certain length of time has elapsed, whereupon a timer opens the circuit and thus deactivates the belly light. Fogarty, et al., U.S. Pat. No. 4,464,861, issued on Aug. 14, 1984, discloses a doll containing an electric lighting circuit including an incandescent bulb and a pressure activated switch.

Sound generation is disclosed in Ting, U.S. Pat. No. 5,211,282, issued on May 18, 1993. Ting discloses a toy containing a squeeze switch which activates either sound stored in a chip, a light source or a vibration mechanism. The squeeze switch includes a switch housing with a forward cup-shaped portion which telescopingly fits around a rearward cup-shaped portion. The housing includes sound passing ports and contains an electric power circuit which is closed and activated by squeezing the housing forward and rearward portions telescopically toward each other and deactivated by permitting an internal spring to drive the housing portions telescopically away from each other. The squeeze switch may be mounted in the belly of a stuffed animal. Lam, et al., U.S. Pat. No. 5,281,180, issued on Jan. 25, 1994, teaches a doll containing a sound generator with pressure switch and optical sensor activation means.

It is thus an object of the present invention to provide an imitative figure having a face structure and material which stores energy from ambient lighting and which radiates light to glow when ambient lighting is substantially diminished or removed.

It is another object of the present invention to provide such a figure having a face region containing an electric light source, the electric light source being activated by applying pressure to the mouth area or chest area of the toy or by bringing pressing opposing limb extremities such as paws or hands together with each other or together with a paw of another such figure, so that the paws or hands are interactive, the light source emitting light of gradually increasing brightness until reaching full intensity.

It is a still further object of the present invention to provide such a figure which not only produces sounds, but also responds to certain sounds to activate the electric light source in the face portion.

It is still another object of the present invention to provide such a figure containing sound generation means which generates a kissing, giggling or other sound when pressure is applied to the mouth area of the toy and which generates a babbling sound of varying pitches when pressure is applied to the chest area of the toy and the toy is abruptly moved.

It is yet another object of the present invention to provide such a figure in which the pitch of the sound generated is varied by variations in ambient light intensity reaching a photocell exposed in the figure upper chest, such that the apparatus generates sounds of higher pitches when in brighter daytime ambient light than when in lower evening ambient light and thus seems more lively and animated in the daytime.

It is finally an object of the present invention to provide such a figure which is economical to manufacture and durable for long and rugged use.

SUMMARY OF THE INVENTION

The present invention accomplishes the above-stated objectives, as well as others, as may be determined by a fair reading and interpretation of the entire specification.

An imitative figure apparatus is provided including a figure body with a body torso and a body head having a face portion with an illumination sheet of luminescent material for absorbing and storing ambient light energy and for producing illumination from the stored light energy, the sheet being oriented so that the produced illumination is directed forwardly from the figure; and a translucent cover secured over the illumination sheet, the translucent cover representing at least part of the face portion.

The translucent cover preferably is configured as a dome having a dome apex. The apparatus preferably additionally includes a mouth and nose representing structure secured to the exterior of the dome substantially at the dome apex. The dome preferably has a dome inner surface which is frosted, and additionally includes eye representing structures having two eye support structures, each eye support structure being fitted with an eye disk for representing the pupil of an eye and which is visible through the dome; so that light emitted by the luminescent sheet enhances the visibility of the eye disks within the dome and also causes each eye disk to cast a shadow on the dome inner surface which appears from outside the dome to surround the eye disks and thus to represent eye whites around eye pupils.

The dome preferably has a dome inner surface which is frosted, and the apparatus preferably additionally includes eye representing structures having two coil springs each having a coil spring first end secured to the dome inner surface behind the mouth and nose representing structure and each having a coil spring second end fitted with an eye disk for representing the pupil of an eye and which is visible through the dome; so that light emitted by the luminescent sheet enhances the visibility of the eye disks within the dome and also causes each eye disk to cast a shadow on the dome inner surface which appears from outside the dome to surround the eye disks and thus to represent whites around eye pupils, and so that movement of the apparatus causes the coil springs and eye disks to giggle. The apparatus preferably additionally includes a sheet back plate, where the sheet back plate is secured across the face portion and has a forward surface and the luminescent sheet is secured to the forward surface, and where the dome is removably secured to the back plate with fasteners.

The apparatus preferably additionally includes an electric light source mounted within the dome; and a light source circuit including the electric light source, a power source and a light source circuit switch and circuit elements which cause the power reaching the light source to increase progressively to its maximum magnitude and thus causing the light source to illuminate gradually. The electric light source preferably is an incandescent bulb and is fitted into a socket mounted to the back plate with wiring extending through the back plate and downward into the chest cavity and the power source preferably is located within the chest cavity.

The dome preferably is hand deformable and resilient to substantially return to its original shape, and the light source switch preferably includes a first pressure switch located inside the dome and having a switch actuation mechanism which is positioned to be operable by rearwardly depressing and deforming the dome against the first pressure switch actuation mechanism. The first pressure switch preferably includes a double pole double throw momentary switch, so that the light source remains activated after pressure against the first pressure switch is removed, and the electricity reaching the light source from the power source gradually diminishes so that the light emitted by the light source progressively diminishes. The electric light source switch mechanism preferably includes a second pressure switch within the chest cavity having a switch actuation structure directed forwardly; so that squeezing the figure torso depresses the actuation structure and closes the second pressure switch and thereby activates the electric light source. The electric light source switch mechanism preferably further includes a magnetic switch and an adjacent magnet contained within at least two of the limb ends, in reversed positions from each other relative to the limb ends in which they are contained; so that placing a limb end against one of: an opposing limb end and a limb end of another such figure, positions the magnet in one limb end adjacent to the magnetic switch in the opposing limb end, thereby activating electric light.

The apparatus preferably additionally includes a first sound circuit for producing a sound simulating a kiss or giggling upon rearwardly depressing and deforming the dome, the first sound circuit including a first speaker, an audio circuit containing a stored kiss or giggle sound, a power source and a first sound circuit pressure switch mounted within the dome. The first sound circuit preferably additionally includes a microphone and switch combination capable of detecting a rapid and abrupt succession of short duration activating sounds; so that externally generating a series of the activating sounds in close proximity to the apparatus causes the microphone and switch combination to activate and close the first sound circuit to cause the generation of sound simulating a kiss, giggle, laugh or other sound.

The apparatus preferably additionally includes a second sound circuit for generating simulated vocal sounds, including an oscillator circuit located within the chest cavity having photocell frequency control elements and a second speaker. The apparatus preferably still further includes a second sound circuit mounting structure contained within the chest cavity and including a channel member; an activation lever having a lever first end pivotally mounted within the channel member and a lever second end protruding forwardly from the channel member, a spring biasing the lever second end outwardly from the channel member, the photocell being mounted to the activation lever forwardly of the figure, a photocell blind mechanism connected to the channel member and extending over the photocell so that the blind mechanism substantially covers and prevents light from entering the photocell when the lever second end is pivoted forwardly and so that the photocell is spaced rearwardly from the blind mechanism to admit light when the lever second end is pivoted rearwardly against the biasing of the spring, the second speaker being mounted to the channel member, the apparatus further including a speaker baffle mounted on a leaf spring, the leaf spring having a free end including a leaf spring weight element and having a leaf spring anchored end secured to the channel member, so that the speaker baffle is positioned in front of the second speaker and pivots to cover and then uncover the speaker as the leaf spring free end swings forwardly and rearwardly about its anchored end to cause sound emitted by the speaker to babble, the sounds being responsive to the extent of apparatus motion, the leaf spring being much more active when the apparatus is oriented to place the figure in a generally vertical, upright position so that figure sounds more awake when upright than when reclining on its back; wherein the on/off switch is mounted on the forward surface of the activation lever; so that depressing the torso inwardly turns the off/on switch on and pivots the lever second end rearwardly toward the channel member, thereby progressively spacing the photocell away from the blind mechanism, and light passing into the figure body reaches the photocell in progressively increasing intensity, thereby progressively increasing the frequency of sound emitted by the audio circuit through the second speaker. The activation lever optionally has an arched segment extending from the lever second end above the lever pin, the arched segment pivoting with the lever forwardly and rearwardly to engage the nose and mouth structure to move the nose and mouth structure in synchronization with sound variations produced by movement of the speaker baffle.

BRIEF DESCRIPTION OF THE DRAWINGS

Various other objects, advantages, and features of the invention will become apparent to those skilled in the art from the following discussion taken in conjunction with the following drawings, in which:

FIG. 1 is a perspective view of the preferred imitative figure in the form of a stuffed animal Teddy Bear, showing the illuminating dome face and body elements.

FIG. 2 is an exploded view of the face portion, showing the translucent dome, luminescent sheet and back board, spring mounted eye disks, electric light source, light and sound activation pressure switch and first sound circuit.

DETAILED DESCRIPTION OF THE PREFERRED EMBODIMENTS

Figure 3:
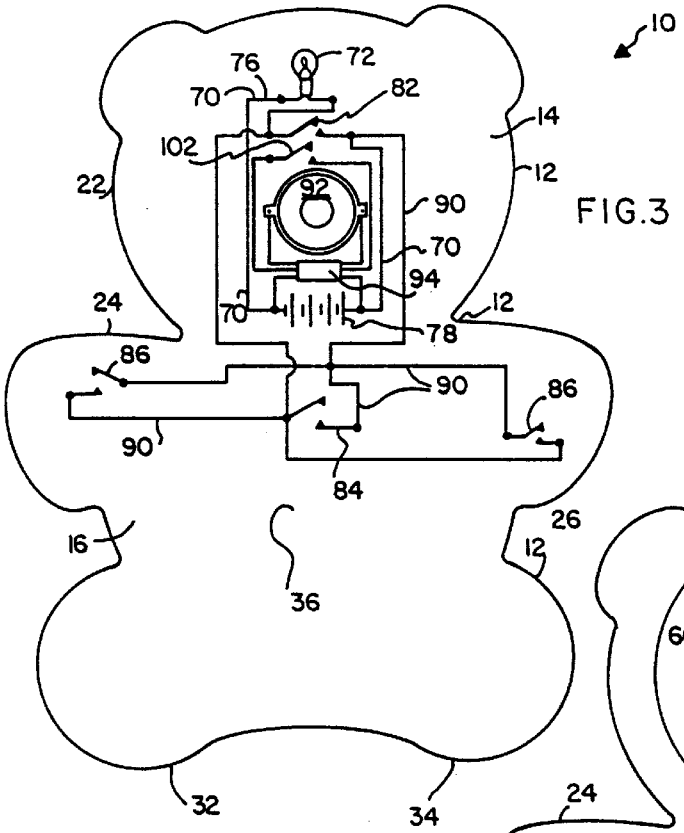
FIG. 3 is a schematic of the figure and the light and first sound circuits, showing the elements of these two circuits which have a common power source and showing the positions of switches within the figure.
Figure 4:
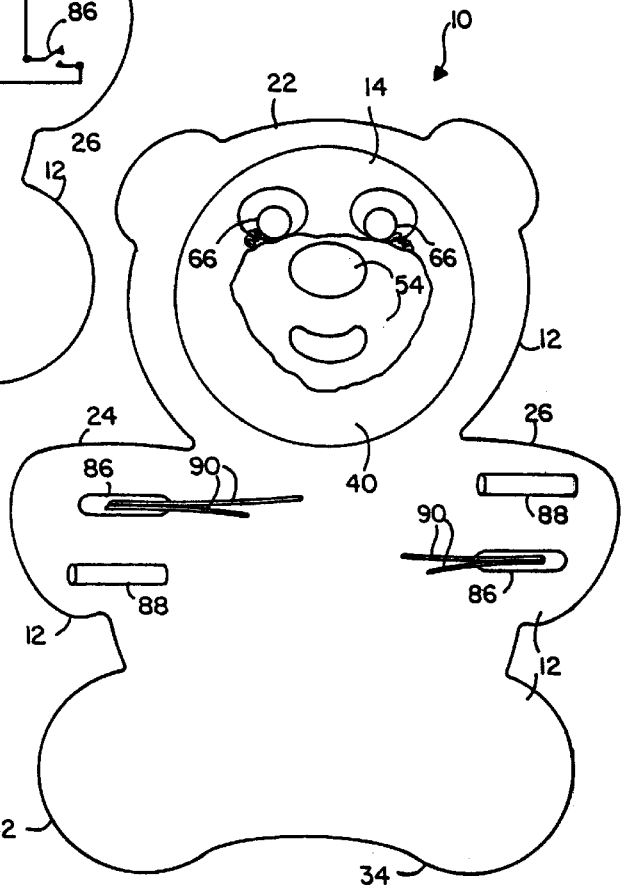
FIG. 4 is a view substantially as in FIG. 3, showing the magnets and magnetic switches in the limb extremities and the figure face portion.
Figure 5:
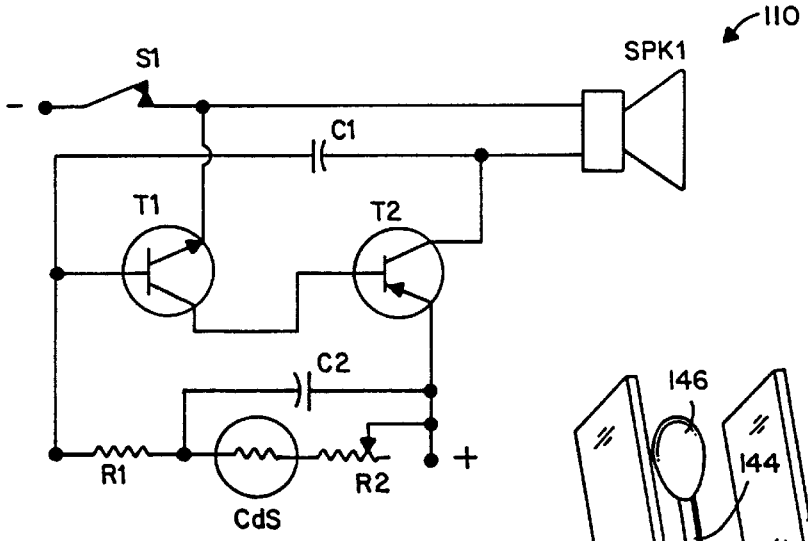
FIG. 5 is a schematic view of the second sound circuit and its elements.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 10:
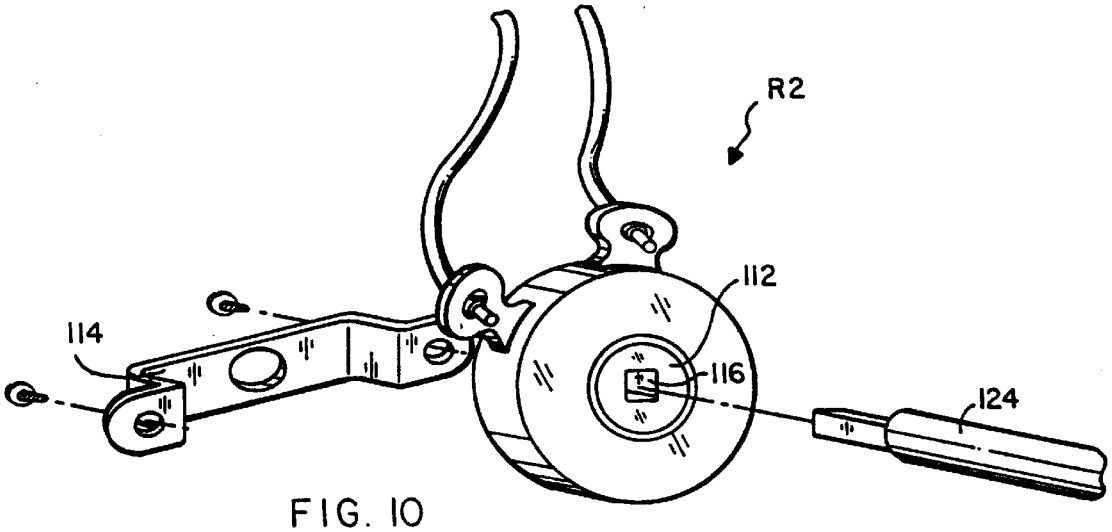
FIG. 10 is a perspective view of the preferred activation lever and connected rheostat structure.

Referring to FIGS. 1–10, an imitative FIG. 10 preferably in the form of a stuffed animal 10 is disclosed. A "imitative figure" for purposes of this application is understood to be a stuffed animal, a doll or any other substantially three-dimensional physical representation of an animal or a person, whether technically accurate or fanciful in appearance. A stuffed animal embodiment is described below for purposes of illustration only.

FIG. 10 includes a figure body 12 having a translucent face portion 14, and which contains means for illuminating the face portion 14 and for generating fanciful sounds intended to represent vocal sounds made by the represented character.

Figure body 12 is preferably configured as a Teddy Bear having a torso 16 with a head 22 and four limbs in the form of two arms 24 and 26 with limb ends in the form of paws 28 and two legs 32 and 34. Torso 16 contains a chest cavity 36 for retaining mechanical and circuit elements, and conventional face portion material is replaced with a circular luminescent sheet 42 covered by a translucent dome 40, having a buffed or abraded dome inner surface to obscure internal mechanisms from view. Luminescent sheet 42 is secured such as with adhesive to a back plate 44 fastened permanently to the head 22 of the FIG. 10. Luminescent sheet 42 preferably includes convolutions 42*a,* such as hemispherical sheet protrusions, to present greater surface area and therefore to absorb light energy more quickly and also to cast light of greater intensity and for a longer period of time. Back plate 44 includes screw ports 46 and dome 40 has screw receiving structures 48 with threaded screw bores, and screws 52 are fitted through each of the screw ports 46 and fastened into the screw receiving structure 48 bores, removably connecting the dome 40 to the back plate 44 and thus to the remainder of FIG. 10. The dome 40 apex exterior surface is covered by a nose and mouth structure 54 marked and configured to represent an animal or other character nose and mouth. Anchored to the inside surface of the dome 40 apex behind the nose and mouth structure 54 are first ends of two face coil springs 62 and 64 which project toward luminescent sheet 42, and face coil springs 62 and 64 have an eye disk 66 of black pigmented metal or plastic affixed to each of the spring 62 and 64 second ends.

Luminescent sheet 42 absorbs and stores a quantity of energy radiated by ambient lighting and illuminates when the ambient lights are shut off, so that the character face portion as represented by dome 40 glows like the moon, and the eye disks 66 and nose appear in silhouette against luminescent sheet 42. The eye disks 66 appearing in silhouette to represent eye pupils and each eye disk 66 also casts a visible shadow against the dome 40 which appears to surround the given eye pupil and to suggest the white of the character eye. Eye disks 66 are mounted on coil springs 62 and 64 so that any sudden displacement of the FIG. 10 causes eye disks 66 to move relative to dome 40 and subsequently to giggle and bounce on the springs 62 and 64, creating a pleasing and relatively life-like animated effect. Although the use of any suitable luminescent material 42 is contemplated, the preferred luminescent material is PALMER™ LUMINOUS GLOW-IN-THE-DARK, NONTOXIC, PERMANENT ACRYLIC PAINT, PALMER™ Item Number 628612, which is a phosphorescent paint that glows in the dark.

FIG. 10 preferably contains three optional electric circuits, one electric light source circuit 70 and first and second sound circuits 90 and 110, respectively. A kiss, giggle, laugh or other sound generation is created by the first sound circuit 90 and a vocal simulation is created by the second sound circuit 110, these two independent circuits jointly occupying portions of the torso cavity. See FIGS. 3, 5 and 6.

Electric light source circuit 70 includes an electric light source 72 which is preferably an incandescent bulb located within dome 40. Electric light source 72 is preferably fitted into a socket 74 mounted to back plate 44 with wiring 76 extending through back plate 44 and down into chest cavity 36. Light source circuit 70 includes and a battery 78 located in chest cavity 36 and a first pressure switch 82 in the nose and mouth structure 54. A second pressure switch 84 in the chest cavity 36 and a magnetic switch 86 in each of the paws 28. See FIGS. 3 and 4. Applying pressure against the nose and mouth structure 54 depresses first pressure switch 82, actuates electric light source 72 and thereby causes the electric light source 72 within dome 40 to light.

First pressure switch 82 is preferably a double pole double throw momentary switch so that electric light source 72 remains activated after pressure against the switch 82 is removed, and the electricity reaching light source 72 slowly diminishes so that the light emitted gradually fades. Progressive illumination and progressive dimming of the intensity of light emitted from electric light source 72 is preferably provided by a power graduation circuit 80. See FIG. 9. Power graduation circuit 80 includes a 6 volt light bulb serving as light source 72, a light first transistor L T1 in the form of an NPN TIP 31 Transistor, a light second transistor L T2 in the form of a PNP 2N3906 Transistor, a light first capacitor L C1 in the form of a 10 Microfarad Electrolytic Capacitor, a first resistor 47K OHM One Quarter Watt Resistor and switch S1.

Current flows from the power source 78 to capacitor L C1 until capacitor L C1 is fully charged, at which point no further current can flow through no current can flow through the circuit 80 to light source 72. When switch L S1 is closed the capacitor L C1 discharges by delivering electric current into circuit 80 through resistor R1, which controls the rate of current flow out of capacitor L C1, and flows through light source 72. The discharge of current from capacitor L C1 is initially low and progressively increases so that light emitted from light source 72 progressively increases in brightness. As capacitor L C1 loses its charge, current from power source 78 is able to begin flowing into capacitor L C1, progressively slowing the rate of current discharge from capacitor L C1 until capacitor L C1 becomes once again fully charged and the current flow stops altogether, so that the current delivered by circuit 80 to light source 72, and thus the brightness of light emitted by light source 72, diminishes to zero. By increasing the capacity of electrolytic capacitor L C1 the light source 72 would glow for a longer period of time. By increasing the value of resistor L R1 the length of time it takes for light source 72 to reach maximum brightness is extended.

Squeezing the figure torso 16 or chest depresses and actuates second pressure switch 84 and once again thereby causes electric light source 72 within the face dome 40 to light, either during the squeezing only or for a pre-set length of time thereafter. The magnetic switches 86 are contained within each paw 28 adjacent to a magnet 88, and relative positions of the magnet 88 and magnetic switch 86 are reversed from one paw 28 to the other paw 28. As a result, placing one paw 28 against an opposing paw 28 or against the paw 28 of another such FIG. 10 positions the magnet 88 in one paw 28 adjacent to the magnetic switch 86 in the opposing paw 28, activates the light circuit 70 in the one or in the two FIGS. 10.

The chest cavity 36 also contains first sound circuit 90 which is constructed to emit a stored sound simulating a kiss, giggle, laugh or other sound when pressure is applied against the nose and mouth structure 54 such as by a person or by the mouth region of another such FIG. 10. First sound circuit 90 includes a speaker 92, an audio circuit 94, a power source in the form of the at least one battery 78 also connected in light circuit 70, and a sound pressure switch 102.

A microphone (not shown) is optionally provided in first sound circuit 90, so that a series of abrupt and brief sounds, such as beeping sounds, perhaps as few as two or three, generated externally of the toy in close succession, are detected by the microphone within the toy, to function as an alternative means for triggering the stored kissing or giggling sound.

Figure 6:
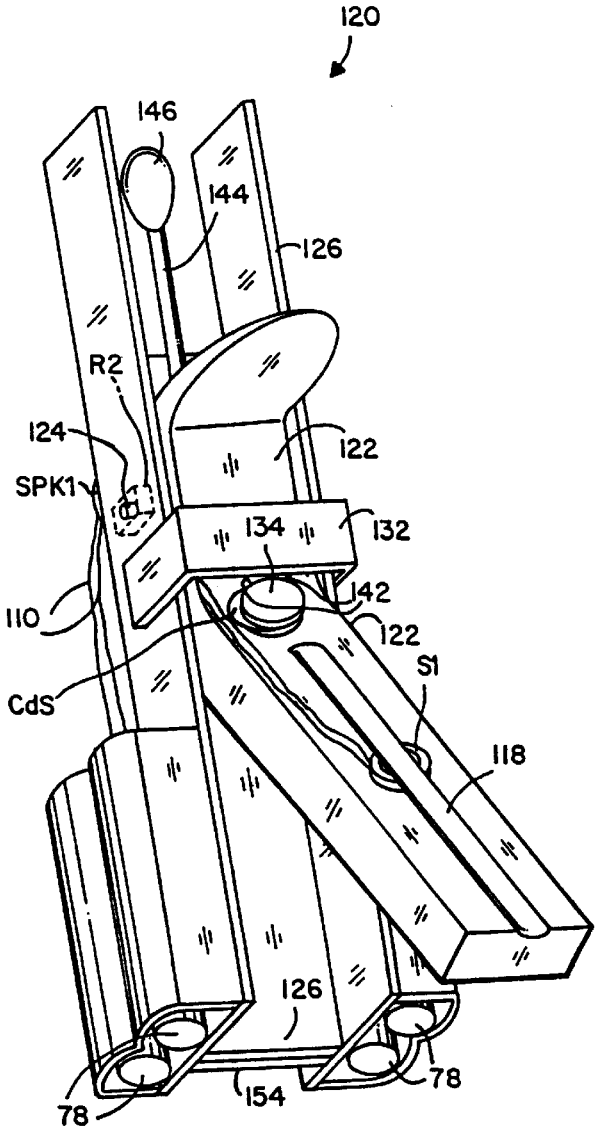
FIG. 6 is a front perspective view of the mechanical structure in which the second sound circuit is preferably mounted.

Second sound circuit 110 emits motion responsive sounds representing character vocal sounds when the torso 16 is squeezed. It is essentially an oscillator circuit containing a photocell exposed on the outer surface of the upper figure chest which controls sound frequency. Ambient light activates the photocell to varying degrees to alter sound frequency. Referring to FIG. 6, second sound circuit 110 includes an on/off switch S1, a speaker SPK1 which is preferably an 8 ohm speaker, two capacitors C1 and C2 which are preferably a 0.1 Mfd capacitor and a 47 Mfd capacitor, two transistors T1 and T2 which are preferably a transistor NPN 2N3904 and a transistor PNP 2N3906, two resistors R1 and R2 which are preferably a resistor 10K and ¼ watt and a resistor 25K and ¼ watt, and a photocell CdS which is preferably a cadmium-sulfide photocell and which controls the frequency of sound generated by second sound circuit 110. Resistor R2 is preferably a rheostat for altering sound pitch, as further explained in the paragraphs which follow. Switch S1 might be further described as a momentary—(NO) normally open—pressure sensitive—switch. The oscillator circuit 110 employs capacitor C2 in order to create a varying frequency rate when activated and deactivated (opening and closing of momentary—normally open on/off switch S1).

Figure 7:
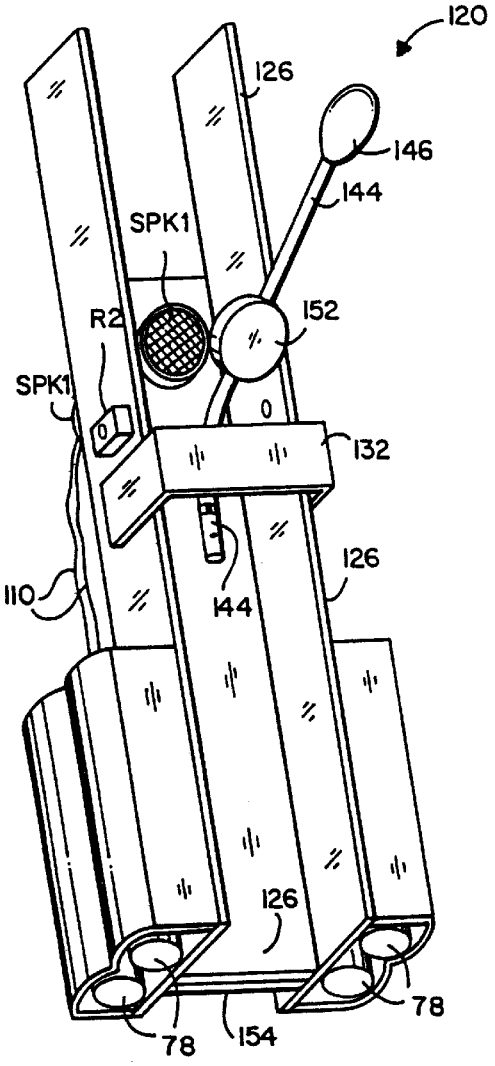
FIG. 7 is a view as in FIG. 6, with the activation lever removed to reveal the leaf spring mounted sound baffle structure.
Figure 8:
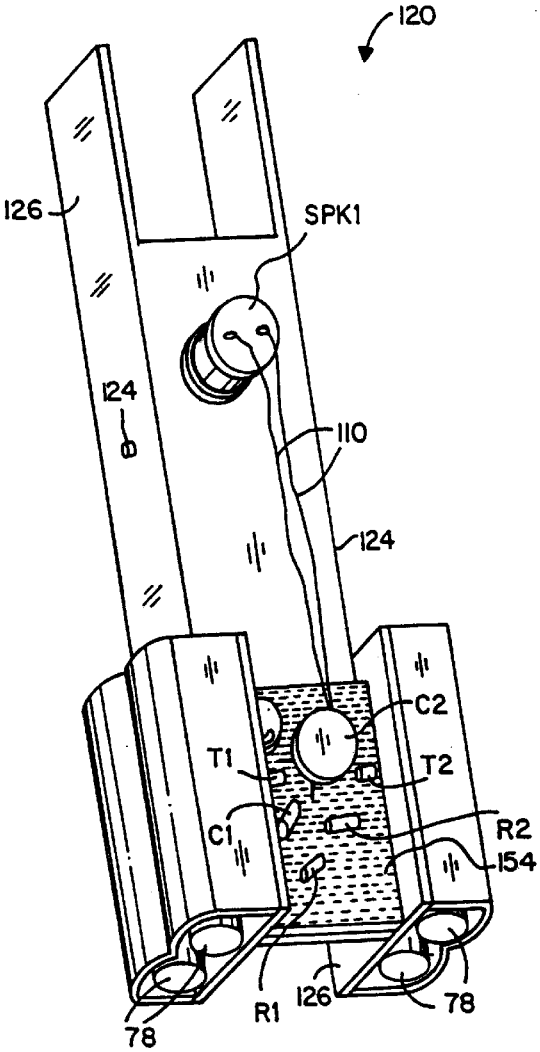
FIG. 8 is a rear perspective view of the mechanical structure of FIGS. 6 and 7, showing the circuit board and its mounted elements.
Figure 9:
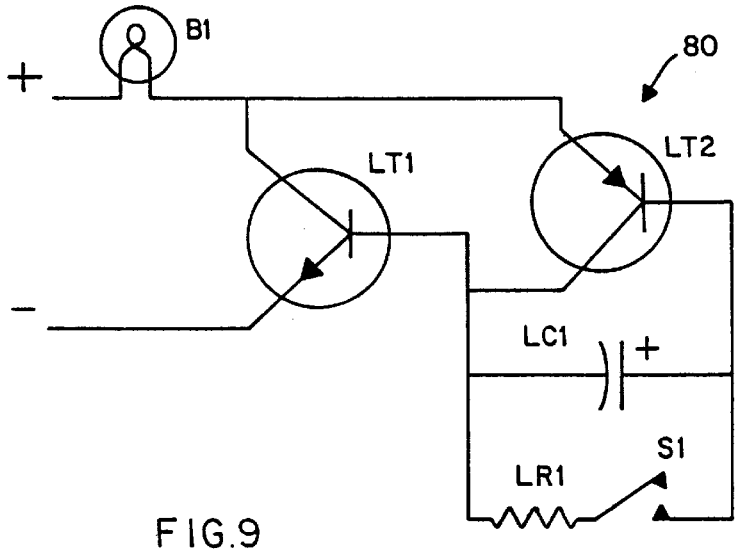
FIG. 9 is a schematic of the preferred power graduation circuit for gradually increasing and for gradually dimming the intensity of light emitted by the electric light source.

Second sound circuit 110 is preferably incorporated into a mechanical structure 120 as shown in FIGS. 6–8 which is contained within chest cavity 36. On/off switch S1 is mounted on the forward surface of an activation lever 122 underneath a flexible band 118, lever 122 being pivotally mounted on a lever pin 124 extending through a channel member 126 and affixed to activation lever 122. Rheostat R2 is preferably affixed to the pivot point of activation lever 122 such that movement of lever 122 twists the knob of Rheostat R2 to alter sound pitch. See FIG. 10. The rheostat R2 is of a type having a carbon arch wired at one end to the circuit 110 and a radial arm wired to the circuit and rotatably mounted on a rheostat axle 112 to sweeping over and thus to make electrical contact along a range of points with the carbon arch. The range of points of radial arm contact with the carbon arch define electricity paths through the carbon arch of a range of lengths so that resistance is continually varied as the radial arm sweeps along the carbon arch. Rheostat R2 is anchored to the channel member 126 with a bracket 114 and the rheostat axle 112 is connected to the lever pin 124 to rotate as one with lever pin 124, so that pivoting of activation lever 122 rotates the rheostat axle and thereby progressively alters the pitch of sound generated. It is preferred that rheostat axle 112 have an axle end bore 116 of square cross-section and that lever arm 124 have a projecting end of square cross-section which fits engagingly into axle end bore 116. A lever coil spring 128 is mounted between and connected at each end to the channel member 126 and the activation lever 122, respectively, to forwardly bias activation lever 122.

As an alternative to rheostat R2, the pitch of sound emitted by speaker SPK1 is made to vary with the position of activation lever 122 by mounting photocell CdS on activation lever 122 behind a fixed blind disk 134. Photocell CdS is mounted to the forward face of activation lever 122 adjacent to lever pin 124 and faces forward. A forward plate 132 extends over the forward face of the channel member 126 just above activation lever 122 and a photocell blind disk 134 extends downwardly from forward plate 132 on wires 142 to cover the photocell CdS when activation lever 122 is in its forwardmost position. As the torso 16 is squeezed, the free end of activation lever 122 pivots rearwardly about its pivot end toward the channel member 126, and light passing through the figure body 12 fabric and fur reaches photocell CdS in progressively increasing intensity. This progressive activation of photocell CdS increases the frequency of the sound emitted by the audio circuit through speaker SPK 1.

The activation lever 122 pivot end extends upwardly from lever pin 124 and underneath the forward plate 132 and contacts and thereby functions as a stop for activation lever 122 when the lever 122 reaches its intended forwardmost position. Activation lever 122 extends upwardly from the forward plate 132 and then optionally arches forwardly to engage the mouth portion of the FIG. 10 to move the mouth simultaneously with the emission of sound. Speaker SPK1 is mounted through a port in channel member 126 above forward plate 132 to emit sound in a forward direction. A leaf spring 144 is anchored within channel member 126 forward face and extends upwardly and over the speaker SPK1 and has a free top end fitted with a weight element 146. A sound baffle disk 152 is secured to leaf spring 144 directly forwardly of speaker SPK1. Movement of the FIG. 10 causes the weight element 146 to pivot leaf spring 144 forwardly and rearwardly in a repetitive swinging motion so that sound baffle disk 152 repeatedly covers and uncovers speaker SPK1, creating an appealing babbling sound. The frequency of the babbling sound varies continuously as varying light intensity reaches photocell CdS through the body 12 fabric. The batteries 78 are preferably mounted to opposing sides of the channel member 126, and the remaining circuit elements are preferably mounted to a circuit board 154 affixed to the rear surface of channel member 126 between the batteries 78. See FIGS. 6–8.

Thus applying pressure to the free end of activation lever 122 depresses switch S1 to activate speaker SPK1 and then permits light to enter photocell CdS to progressively alter the sound frequency. This application of pressure is typically performed while the user holds the FIG. 10, and thus there is usually sufficient movement of the FIG. 10 cause weight element 146 and leaf spring 144 to swing, and in turn to cause the sound to fluctuate in the above-described babble pattern.

The leaf spring 144 abuts the activation lever 122 pivot end as it swings forwardly. The range of the leaf spring 144 swing is thus determined by how close the activation lever 122 pivot end is pivoted toward channel member 126 and thus defines the size of the opening between channel member 126 and activation lever 122, which varies through the pivot of the activation lever 122.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An imitative figure apparatus, comprising:

a figure body comprising a body torso and a body head having a face portion comprising an illumination sheet of luminescent material for absorbing and storing ambient light energy and for producing illumination from the stored light energy, said sheet being oriented such that the produced illumination is directed forwardly from said figure;

and a translucent cover secured over said illumination sheet, said translucent cover representing at least part of said face portion.

2. The apparatus of claim 1, wherein said translucent cover is configured as a dome having a dome apex.

3. The apparatus of claim 2, additionally comprising a mouth and nose representing structure secured to the exterior of said dome substantially at said dome apex.

4. The apparatus of claim 3, wherein said dome has a dome inner surface which is frosted, additionally comprising eye representing structures comprising two eye support structures, each said eye support structure being fitted with an eye disk for representing the pupil of an eye and which is visible through said dome;

such that light emitted by said luminescent sheet enhances the visibility of said eye disks within said dome and also causes each said eye disk to cast a shadow on said dome inner surface which appears from outside said dome to surround said eye disks and thus to represent eye whites around eye pupils.

5. The apparatus of claim 3, wherein said dome has a dome inner surface which is frosted, additionally comprising eye representing structures comprising two coil springs each having a coil spring first end secured to said dome inner surface behind said mouth and nose representing structure and each having a coil spring second end fitted with an eye disk for representing the pupil of an eye and which is visible through said dome;

such that light emitted by said luminescent sheet enhances the visibility of said eye disks within said dome and also causes each said eye disk to cast a shadow on said dome inner surface which appears from outside said dome to surround said eye disks and thus to represent whites around eye pupils, and such that movement of said apparatus causes said coil springs and eye disks to giggle.

6. The apparatus of claim 2, additionally comprising a sheet back plate, wherein said sheet back plate is secured across said face portion and has a forward surface and said luminescent sheet is secured to said forward surface, and wherein said dome is removably secured to said back plate with fastener means.

7. The apparatus of claim 6, additionally comprising:

an electric light source mounted within said dome;

and a light source circuit including said electric light source and a power source and light source circuit switch means.

8. The apparatus of claim 7, wherein said electric light source is an incandescent bulb and is fitted into a socket mounted to said back plate with wiring extending through said back plate and downward into said chest cavity and wherein said power source is located within said chest cavity.

9. The apparatus of claim 7, wherein said dome is hand deformable and resilient to substantially return to its original shape, and wherein said light source switch means comprises:

a first pressure switch located inside said dome and having a switch actuation means which is positioned to be operable by rearwardly depressing and deforming said dome against said first pressure switch actuation means.

10. The apparatus of claim 9, wherein said first pressure switch comprises a double pole double throw momentary switch, such that said light source remains activated after pressure against said first pressure switch is removed, and the electricity reaching said light source from said power source gradually diminishes such that the light emitted by said light source progressively diminishes.

11. The apparatus of claim 8, wherein said electric light source switch means comprises:

a second pressure switch within said chest cavity having switch actuation means directed forwardly;

such that squeezing the figure torso depresses said actuation means and closes said second pressure switch and thereby activates said electric light source.

12. The apparatus of claim 7, wherein said electric light source switch means comprises:

a magnetic switch and an adjacent magnet contained within at least two said limb ends;

such that placing one said limb end against one of: an opposing said limb end and a limb end of another such figure, positions the magnet in one said limb end adjacent to the magnetic switch in the opposing said limb end, thereby activating said electric light.

13. The apparatus of claim 2, additionally comprising:

a first sound circuit for producing a sound simulating a kiss upon rearwardly depressing and deforming said dome, said first sound circuit comprising a first speaker, an audio circuit containing a stored kiss sound, a power source and a first sound circuit pressure switch mounted within said dome.

14. The apparatus of claim 13, additionally comprising a second sound circuit for generating simulated vocal sounds, comprising:

an oscillator circuit located within said chest cavity comprising photocell frequency control means and a second speaker.

15. The apparatus of claim 14, additionally comprising:

a second sound circuit mounting structure contained within said chest cavity and comprising a channel member; an activation lever having a lever first end pivotally mounted within said channel member and a lever second end protruding forwardly from said channel member, spring means biasing said lever second end outwardly from said channel member, said photocell being mounted to said activation lever forwardly of said figure, photocell blind means connected to said channel member and extending over said photocell such that said blind means substantially covers and prevents light from entering said photocell when said lever second end is pivoted forwardly and such that said photocell is spaced rearwardly from said blind means to admit light when said lever second end is pivoted rearwardly against the biasing of said spring means, said second speaker being mounted to said channel member, said apparatus further comprising a speaker baffle mounted on a leaf spring, said leaf spring having a free end including a leaf spring weight element and having a leaf spring anchored end secured to said channel member, such that said speaker baffle is positioned in front of said second speaker and pivots to cover and then uncover said speaker as said leaf spring free end swings forwardly and rearwardly about its anchored end to cause sound emitted by said speaker to babble;

wherein said on/off switch is mounted on the forward surface of said activation lever;

such that depressing said torso inwardly turns said off/on switch on and pivots said lever second end rearwardly toward said channel member, thereby progressively spacing said photocell away from said blind means, and light passing into said figure body reaches said photocell in progressively increasing intensity, thereby progressively increasing the frequency of sound emitted by said audio circuit through said second speaker.

16. The apparatus of claim 15, wherein said activation lever has an arched segment extending from said lever second end above said lever pin, said arched segment pivoting with said lever forwardly and rearwardly to engage said nose and mouth structure to move said nose and mouth structure in synchronization with sound variations produced by movement of said speaker baffle.

17. The apparatus of claim 13, additionally comprising a second sound circuit for generating simulated vocal sounds, comprising:

an oscillator circuit located within said chest cavity comprising rheostat frequency control means and a second speaker.

18. The apparatus of claim 17, additionally comprising:

a second sound circuit mounting structure contained within said chest cavity and comprising a channel member; an activation lever having a lever first end pivotally mounted within said channel member and a lever second end protruding forwardly from said channel member, spring means biasing said lever second end outwardly from said channel member, said rheostat having a rheostat axle which is rotatable to alter the rheostat resistance, said rheostat axle being mounted to said activation lever to rotate as said activation lever pivots, said second speaker being mounted to said channel member, said apparatus further comprising a speaker baffle mounted on a leaf spring, said leaf spring having a free end including a leaf spring weight element and having a leaf spring anchored end secured to said channel member, such that said speaker baffle is positioned in front of said second speaker and pivots to cover and then uncover said speaker as said leaf spring free end swings forwardly and rearwardly about its anchored end to cause sound emitted by said speaker to babble;

wherein said on/off switch is mounted on the forward surface of said activation lever;

such that depressing said torso inwardly turns said off/on switch on and pivots said lever second end rearwardly toward said channel member and against the biasing of said spring means, thereby progressively rotating said rheostat axle and thus progressively increasing the frequency of sound emitted by said audio circuit through said second speaker.

* * * * *